US005755004A

United States Patent [19]

Miller

[11] Patent Number: 5,755,004

[45] Date of Patent: May 26, 1998

[54] ROLLER BRUSH RETAINER

[76] Inventor: Wesley B. Miller, 1073 Cherry St., Pottstown, Pa. 19464

[21] Appl. No.: 696,043

[22] Filed: Aug. 13, 1996

[51] Int. Cl.[6] ..... B05C 1/08

[52] U.S. Cl. ..... 15/230.11; 492/19

[58] Field of Search ..... 15/230.11; 492/13, 492/14, 16–19

[56] References Cited

U.S. PATENT DOCUMENTS

| | | | |
|---|---|---|---|
| 4,316,301 | 2/1982 | Smith et al. | 15/230.11 |
| 4,467,509 | 8/1984 | Dezen | 492/13 |
| 5,594,971 | 1/1997 | Nelson | 15/230.11 |

FOREIGN PATENT DOCUMENTS

| | | | |
|---|---|---|---|
| 2693387 | 1/1994 | France | 15/230.11 |

*Primary Examiner*—Terrence Till

[57] ABSTRACT

A roller brush retainer including a retention structure for preventing a paint roller's tube brush from sliding off the roller. The paint roller includes a handle, a roller, a tube brush, and in one embodiment of the invention the retaining structure includes a retaining groove and a retaining ring. In use, the tube brush is slid onto the roller of a paint roller and the retention structure is mounted on the roller by spring biased action. The retainer means is used to securely and effectively hold the tube brush onto the roller and therefore prevent accidental disengagement and mess.

9 Claims, 3 Drawing Sheets

FIG 1

FIG 3
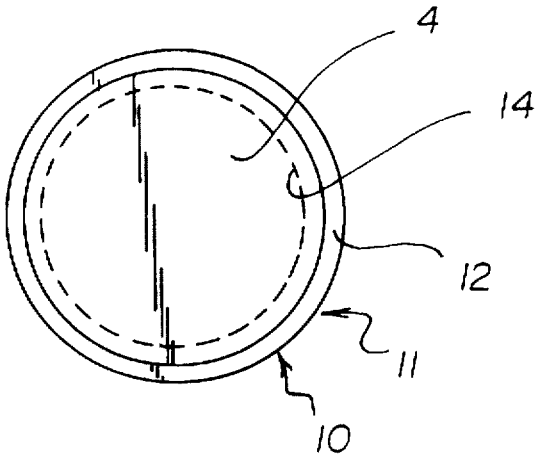
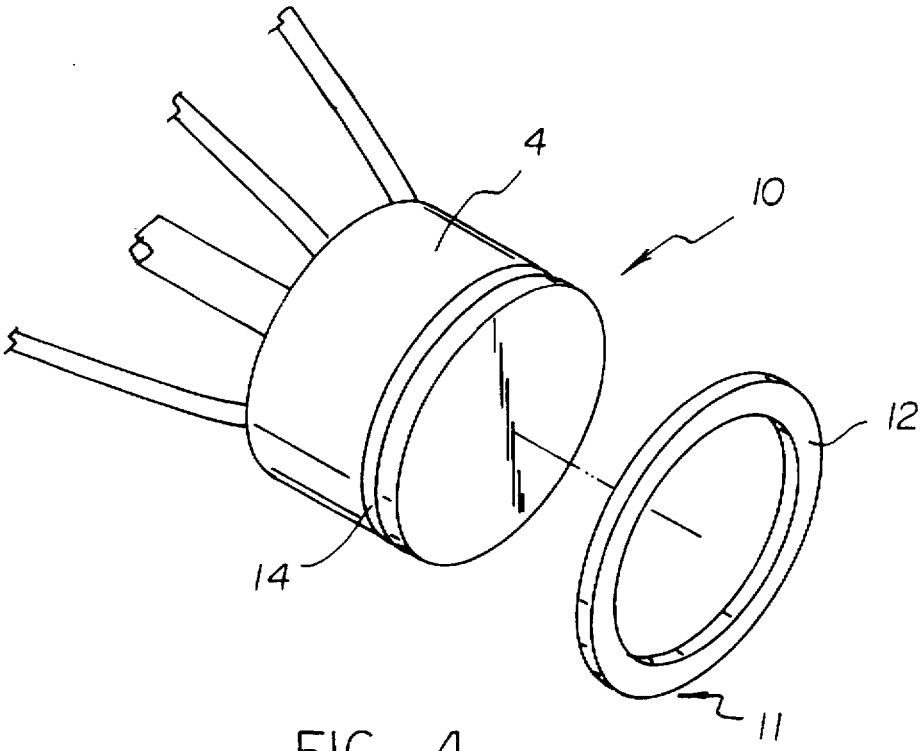
FIG 4

ROLLER BRUSH RETAINER

BACKGROUND OF THE INVENTION

1. Field of the Invention

The present invention relates to paint rollers and more particularly pertains to a new Roller Brush Retainer for offering a retention means to prevent a paint roller's tube brush from sliding off the roller.

2. Description of the Prior Art

The use of paint rollers is known in the prior art. More specifically, paint rollers heretofore devised and utilized are known to consist basically of familiar, expected and obvious structural configurations, notwithstanding the myriad of designs encompassed by the crowded prior art which have been developed for the fulfillment of countless objectives and requirements.

Known prior art paint rollers include U.S. Pat. No. 5,167,055; U.S. Pat. No. 4,897,893; U.S. Pat. No. 4,717,276; U.S. Pat. No. 4,295,241; U.S. Pat. No. 4,316,301; and U.S. Pat. No. 336,162.

While these devices fulfill their respective, particular objectives and requirements, the aforementioned patents do not disclose a new Roller Brush Retainer. The inventive device includes a handle, a roller, a tube brush, a retaining groove, and a retaining ring.

In these respects, the Roller Brush Retainer according to the present invention substantially departs from the conventional concepts and designs of the prior art, and in so doing provides an apparatus primarily developed for the purpose of offering a retention means to prevent a paint roller's tube brush from sliding off the roller.

SUMMARY OF THE INVENTION

In view of the foregoing disadvantages inherent in the known types of paint rollers now present in the prior art, the present invention provides a new Roller Brush Retainer construction wherein the same can be utilized for offering a retention means to prevent a paint roller's tube brush from sliding off the roller.

The general purpose of the present invention, which will be described subsequently in greater detail, is to provide a new Roller Brush Retainer apparatus and method which has many of the advantages of the paint rollers mentioned heretofore and many novel features that result in a new Roller Brush Retainer which is not anticipated, rendered obvious, suggested, or even implied by any of the prior art paint rollers, either alone or in any combination thereof.

To attain this, the present invention generally comprises a handle, a roller, a tube brush, a retaining groove, and a retaining ring.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Roller Brush Retainer apparatus and method which has many of the advantages of the paint rollers mentioned heretofore and many novel features that result in a new Roller Brush Retainer which is not anticipated, rendered obvious, suggested, or even implied by any of the prior art paint rollers, either alone or in any combination thereof.

It is another object of the present invention to provide a new Roller Brush Retainer which may be easily and efficiently manufactured and marketed.

It is a further object of the present invention to provide a new Roller Brush Retainer which is of a durable and reliable construction.

An even further object of the present invention is to provide a new Roller Brush Retainer which is susceptible of a low cost of manufacture with regard to both materials and labor, and which accordingly is then susceptible of low prices of sale to the consuming public, thereby making such Roller Brush Retainer economically available to the buying public.

Still yet another object of the present invention is to provide a new Roller Brush Retainer which provides in the apparatuses and methods of the prior art some of the advantages thereof, while simultaneously overcoming some of the disadvantages normally associated therewith.

Still another object of the present invention is to provide a new Roller Brush Retainer for offering a retention means to prevent a paint roller's tube brush from sliding off the roller.

Yet another object of the present invention is to provide a new Roller Brush Retainer which includes a handle, a roller, a tube brush, a retaining groove, and a retaining ring.

Still yet another object of the present invention is to provide a new Roller Brush Retainer that makes painting less messy by preventing the tube brush from falling off onto a carpeted floor or the like.

Even still another object of the present invention is to provide a new Roller Brush Retainer that improves existing paint roller design.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an end view of the present invention taken along line 3—3 of FIG. 2.

FIG. 4 is an enlarged detailed perspective view of the retained end of a roller of the present invention.

DESCRIPTION OF THE PREFERRED EMBODIMENT

Figure 1:
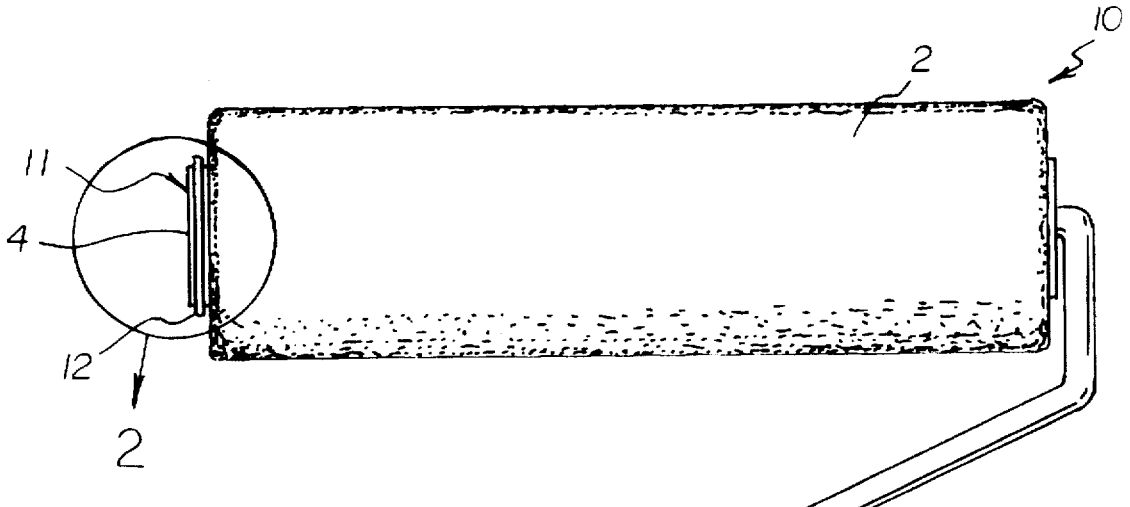
FIG. 1 is a side elevation view of a new Roller Brush Retainer according to the present invention.
Figure 2:
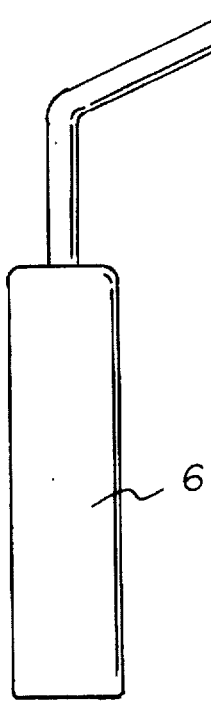
FIG. 2 is an enlarged detail view of an end of a roller to be retained taken about detail 2 of FIG. 1.
Figure 2:
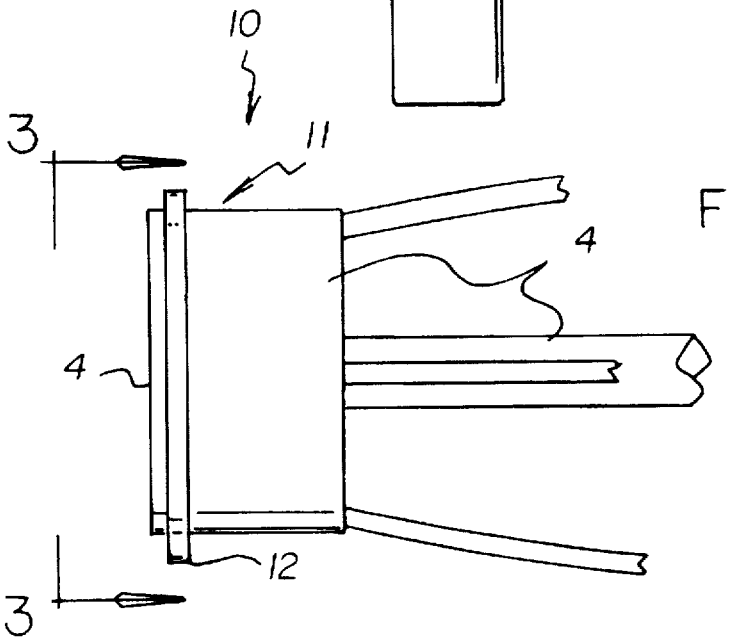

With reference now to the drawings, and in particular to FIGS. 1 through 7 thereof, a new Roller Brush Retainer embodying the principles and concepts of the present invention and generally designated by the reference numeral 10 will be described.

More specifically, it will be noted that the Roller Brush Retainer 10 comprises a handle 6, a roller 4, a tube brush 2, a retaining groove 14, and a retaining ring 12 where an old and well known paint roller including the handle 6, the roller 4, and the tube brush 2 include another feature where the roller 4 comprises the retaining groove 14 at an outer periphery of a distal end of the roller 4 and the retaining ring 12 is spring biasedly received within the retaining groove 14 and is radially extensible and whereby the retaining ring 12 retains the tube brush 2 onto the roller 4.

Figure 5:
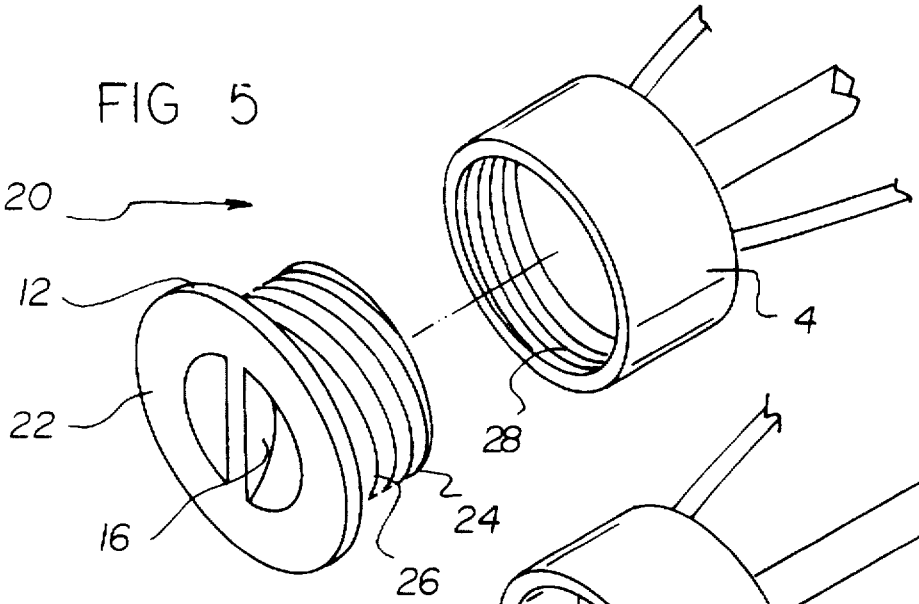
FIGS. 5, 6, and 7 are enlarged detailed perspective views of alternate embodiments of end retainers of a rollers of the present invention.
Figure 6:
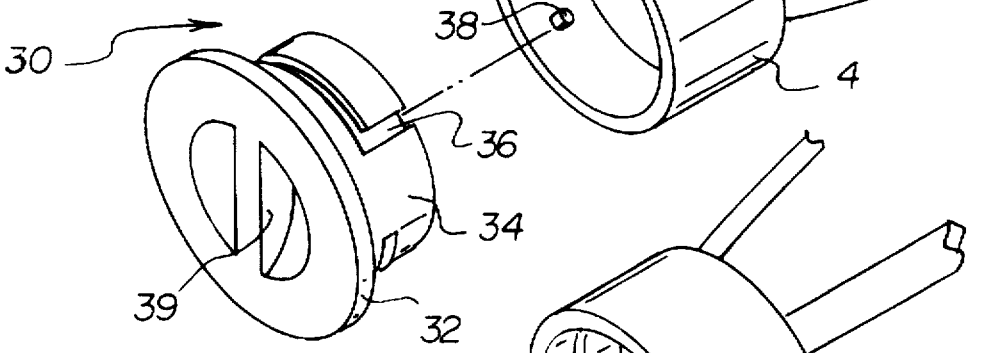
Figure 7:
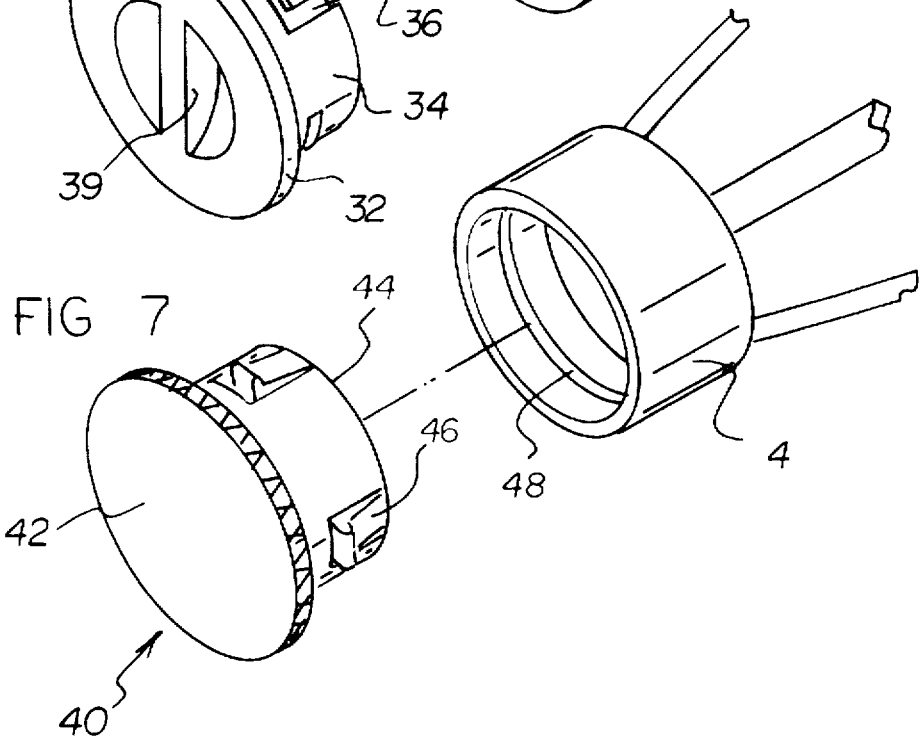

As best illustrated in FIGS. 5 through 7, it can be shown that the Roller Brush Retainer 10 can be accomplished by any one of several alternate retainer means 11.

Referring to FIG. 5, the retainer means 11 could be effectively accomplished by a screw type cap 20 where a screw cap ring 22 is integrated annularly onto an end of a cylindrical insert 24 having a screw thread 26 and where the roller 4 is equipped with a mating screw thread 28 and a twist handle 16 is recessed into the end of the cylindrical insert 24 and where by turning of the twist handle 16, the cylindrical insert 24 threadedly engages the mating screw thread 28 and therefore the roller 4. The handle 16 comprises a pair of opposed semicircular recesses in the locking cap 20 with a finger grippable wall between recesses for pinching by the fingers of a user. This is the same handle shown in FIG. 6.

Referring to FIG. 6, the retainer means 11 could be effectively accomplished by a channel lock cap 30 where a channel lock cap ring 32 is integrated annularly onto an end of a channel lock insert 34 having a channel 36 which has an axially oriented entrance portion and an annularly oriented locking portion and where the roller 4 is equipped with a mating lock knob 38 and a lock handle 39 is recessed into the end of the channel lock insert 34 and where by turning of the lock handle 39, the channel lock insert 34 lockingly engages the mating lock knob 38 and therefore the roller 4.

Referring to FIG. 7, the retainer means 11 could be effectively accomplished by a snap lock cap 40 where a snap lock cap ring 42 is integrated annularly onto an end of a snap lock insert 44 having a snap tab 46 that is spring biased outwardly and where the roller 4 is equipped with a mating lock recess 48 which is a annular groove and a handle grip 49 is included around the periphery of the snap lock cap ring 42 and where by gripping of the knurled outer surface of the handle grip 49, the snap lock insert 44 spring biasedly locks in engagement with the mating lock recess 48 and therefore the roller 4.

In use, the tube brush 2 is slid onto the roller 4 of a paint roller and where the roller 4 ineffectively held the tube brush 2 onto the roller 4 by spring biased action, the retainer means 11 is used to securely and effectively hold the tube brush 2 onto the roller 4 and therefore prevent accidental disengagement and mess.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A roller brush retainer for a paint roller, said paint roller having a handle, a roller, and a tube brush, said retainer comprising:

a retainer means for retaining the tube brush on the roller, said retainer means comprising a locking cap with a substantially cylindrical outer surface and an annular ridge extending radially outward from the cylindrical outer surface thereof, and a substantially cylindrical receiving ring mounted on a free end of the roller of a paint roller, said receiving ring having a hollow substantially cylindrical interior surface for removably receiving said locking cap, said locking cap having handle means for permitting finger rotation of said locking cap, wherein the outer surface of said locking cap has a channel and the interior surface of said receiving ring has at least one knob for engaging the channel in said locking cap, said channel and said knob being selectively interlockable to removably secure said locking cap to said retaining ring.

2. The roller brush retainer of claim 1 wherein said channel has an axially oriented entrance portion and a annularly oriented locking portion.

3. The roller brush retainer of claim 1 wherein said handle means comprises a pair of opposed semicircular recesses in the locking cap with a finger grippable wall between said recesses for pinching by the fingers of a user.

4. A roller brush retainer for a paint roller, said paint roller having a handle, a roller, and a tube brush, said retainer comprising:

a retainer means for retaining the tube brush on the roller, said retainer means comprising a locking cap with a substantially cylindrical outer surface and an annular ridge extending radially outward from the cylindrical outer surface thereof, and a substantially cylindrical receiving ring mounted on a free end of the roller of a paint roller, said receiving ring having a hollow substantially cylindrical interior surface for removably receiving said locking cap, said locking cap having handle means for permitting finger rotation of said locking cap, wherein the outer surface of said locking cap has at least one snap tab biased radially outward from said outer surface, and wherein the interior surface of said receiving ring has a lock recess therein for receiving said snap tab, said snap tab and said lock recess being selectively interlockable to removably secure said locking cap to said retaining ring.

5. The roller brush retainer of claim 4 wherein said annular ridge has a knurled outer surface for gripping by the hand of a user.

6. The roller brush retainer of claim 4 wherein said locking recess comprises an annular groove in the interior surface of said receiving ring.

7. A roller brush retainer for a paint roller, said paint roller having a handle, a roller, and a tube brush, said retainer comprising:

a retainer means for retaining the tube brush on the roller, said retainer means comprising a roller end cap with a substantially cylindrical outer surface and being mounted on a free end of a roller, said roller end cap having an annular retaining groove in the outer surface thereof, and a retaining ring releasably mountable in said retaining groove to block movement of a tube brush from said roller when said retaining ring is mounted on said locking cap.

8. The roller brush retainer of claim 7 where in use, the tube brush is slid onto the roller of a paint roller and where the retainer means securely holds the tube brush onto the roller and therefore prevents accidental disengagement.

9. The roller brush retainer of claim 7 wherein said retaining ring comprises a radially-extensible member.

* * * * *